US005806416A

United States Patent [19]

Cerniglia et al.

[11] Patent Number: 5,806,416

[45] Date of Patent: Sep. 15, 1998

[54] YARD AND TRASH COMPACTOR

[76] Inventors: James A. Cerniglia; Mary A. Cerniglia-Mosher, both of 3604 Sequoia Way, Valrico, Fla. 33594

[21] Appl. No.: 825,342

[22] Filed: Mar. 28, 1997

[51] Int. Cl.[6] ..... B30B 9/30

[52] U.S. Cl. ..... 100/90; 53/390; 53/527; 100/229 A; 100/246; 141/390

[58] Field of Search ..... 100/90, 229 A, 100/240, 246, 265; 53/390, 527; 141/71, 73, 80, 390, 391

[56] References Cited

U.S. PATENT DOCUMENTS

| | | | |
|---|---|---|---|
| 3,528,366 | 9/1970 | Neuenburg et al. | 100/246 |
| 3,722,561 | 3/1973 | O'Leary et al. | 53/527 |
| 3,734,008 | 5/1973 | Akerberg | 100/229 A |
| 3,935,692 | 2/1976 | Miller | 53/527 |
| 4,416,197 | 11/1983 | Kehl | 100/229 A |
| 4,991,500 | 2/1991 | Knapp | 100/90 |

FOREIGN PATENT DOCUMENTS

| | | | |
|---|---|---|---|
| 1150215 | 7/1983 | Canada | 53/390 |

*Primary Examiner*—Stephen F. Gerrity

[57] ABSTRACT

A device designed to compress yard debris such as leaves, bush trimmings, and grass clippings inside a plastic trash bag without damaging the structural integrity of the plastic bag during the loading or filling process and during the compression cycle. This invention consist of four individual component parts; a hollow, smooth cylinder opened at both ends with a pair of handles at one end; a durable attachable bottom which caps one end of the cylinder; a plastic trash bag; and a flat, sturdy and durable piston which will fit inside the cylinder and which is used to compress loaded yard debris. The invention is assembled by placing the ridged, hollow cylinder inside a plastic trash bag and securing this elongated bag to the upper end of the cylinder with an elastic bungee cord of specific dimension and tension. The bottom is secured to cap off one end of the cylinder by use of two elastic bungee cords which are attached to the two handles of the cylinder.

5 Claims, 2 Drawing Sheets

YARD AND TRASH COMPACTOR

BACKGROUND—FIELD OF THE INVENTION

This invention relates to a lightweight, movable refuse receiving assemblies capable of compressing refuse in a plastic bag while facilitating loading and transportation of the plastic bag.

BACKGROUND—DESCRIPTION OF THE PRIOR ART

Plastic trash bags have become a common and convenient means of collecting and storing refuse for disposal; particularly yard clippings, leaves and hedge trimmings. Plastic bags provide a relatively cheap means of collecting and storing household trash, lawn and shrub clippings, pet litter, and garbage for transportation from the home to dump sites. Plastic bags come in various sizes, thickness, puncture resistant strengths and offer extra features such as drawstrings and handles. All plastic bags, due to the material used and construction methods, take the shape of a cylinder once filled. This invention leverages this important feature to achieve one of its major embodiments; maximizing all available space offered by the volume of the plastic bag thereby requiring fewer plastic bags to accomplish the clean up task. No other prior art takes advantage of this important feature common in all plastic bags. One common drawback all plastic bags have in common is a lack structural rigidity; requiring either two people or some device for the filling process. This drawback usually results in an inefficient use of the plastic bag's available volume; plastic bags can not be loaded to fill capacity without the use of a device which offsets the major inherent weakness of the plastic bag. Another intrinsic weakness in the plastic bag is its susceptibility to puncture during the loading or filling operation. Sticks, twigs, and sharp objects tend to puncture the plastic bag, significantly reducing the load bearing capability of the plastic bag. Once loaded, moving heavily loaded plastic bags to pickup or drop off points is difficult due to structural strength and a lack of load bearing structures common in thin flexible plastic material used to fabricate the bag.

Several devices, such as U.S. Pat. No. 4,890,652 to Hoerner, are available which hold plastic bags open during the filling process, permitting a one man operation, but none allow debris to be compressed in the bag and thereby make maximum use of all available plastic bag volume. Some inventions offset the major weakness of plastic bags, their propensity to puncture, tear, and rip during filling, but do not compress yard debris, leaves, hedge trimmings and trash in the operation of the device. None of the prior art provided a means of compressing light, yet bulky yard debris such as leaves and grass clippings during the filling process. Without the ability to compress this type of refuse, twice as many bags are required to hold the same quantity of debris; plastic bag volume is not maximized. One of the major embodiments of this invention is its capability to compress debris during the loading cycle and then transfer this compressed matter into the plastic bag; protecting the bags structural integrity during loading while maximizing the plastic bags available volume.

Some of the prior art, such as U.S. Pat. No. 4,783,090 to Moulton, while effectively holding the plastic bag open, does not provide a support structure for moving partially filled bags to different locations for loading. Much of the prior art does not protect the sides and bottom of the plastic bag. This makes filling difficult when dealing with branches, hedge clippings, and other sharp, long items of trash. Other devices such as U.S. Pat. No. 4,890,652 protect the sides of the plastic bag and facilitate filling but does not offer protection to the bottom of the bag. This invention also does not conform to the manufactured shape of the plastic bag thereby assuring the bag is only partially filled before the device is slipped out of the plastic bag. This invention makes moving partially filled bags to alternate locations impossible without damage to the bottom of the bag with loss of the contents. Using these types of devices requires moving the debris to the device until the plastic bag is filled. This wastes time, requires more physical work, and makes movement of heavily loaded bags impossible without damage to the bag and/or loss of the bags contents. Some inventions, for example U.S. Pat. No. 4,783,031 issued to Ebentheuer, require intricate clips and fasteners to hold the bag in position and does not protect the bag from puncture or tear by the refuse being loaded. This device, while permitting one man operation during the loading cycle, does not protect the sides of the bag and will not allow debris to be compressed inside the bag without damage to the bag.

OBJECTS AND ADVANTAGES

Accordingly I claim the following as objects and advantages of the invention: to provide the user a lightweight, low cost, durable, versatile, lawn refuse receptacle capable of compressing light, bulky yard debris such as leaves, hedge and bush trimmings, and lawn clippings while completely protecting the plastic bag during filling, compression, and movement. The major object of this device is to use the maximize available volume of the plastic bag used while minimizing the effort required to load, compress, and move yard debris. Additionally, I claim the additional objects and advantages: eliminating the need for assistance in loading plastic bags; saving time and reducing the effort and frustration while filling plastic bags with yard refuse. This invention allows the user to transport heavy and filled plastic trash bags to the pick up site without fear of losing the contents during movement. Additionally, the device can be moved from location to location in the yard for filling without damage to the plastic bag. Further objects and advantages of my invention will become apparent from a consideration of the drawings and ensuing description.

DRAWING REFERENCE NUMERALS

Figure 1:
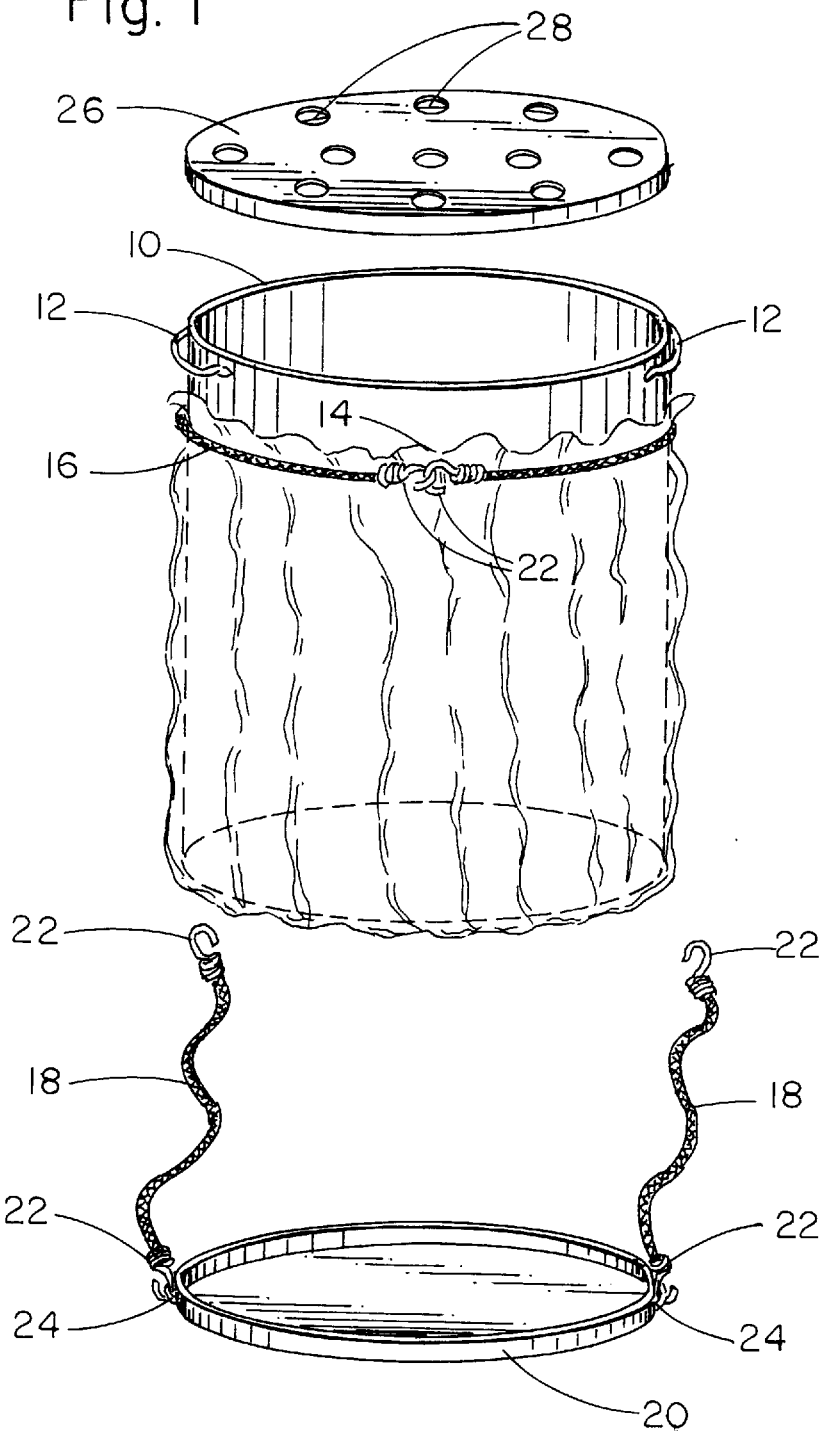
FIG. 1 is a relational perspective view of the component parts.

10 trash receptacle cylinder
12 handle
14 plastic trash bag
16 elastic bungee cord
18 elastic bungee cord
20 cylinder bottom
21 lip edge of bottom 20
22 hook of bungee cord 18 or 16
24 anchor point eyelet
26 compression piston
28 air release holes

YARD AND TRASH COMPACTOR—DESCRIPTION

The description of the invention is simplified by reference to the drawings. FIG. 1 is a relational perspective view of each component of the device prior to assembly and use. The bottom 20 is designed to fit securely over the bottom opening of the trash receptacle cylinder 10 allowing sufficient space between the outer circumference of the trash receptacle cylinder 10 and the inner diameter of the bottom 20 for the thickness of a plastic trash bag 14. The bottom 20 is designed to be attachable and detachable to the trash receptacle cylinder 10. The bottom 20 is made of heavy plastic or similar material which will permit the loaded Yard and Trash Compactor to slide over such surfaces as concrete, grass, or dirt without undue erosion of the material used in the construction of the bottom 20. The bottom 20 is a flat circular plate with a small vertical lip 21 which will accept the outer circumference of the trash receptacle cylinder and prevent the cylinder from slipping outside and off of the bottom 20. The bottom 20 has two anchor point eyelet 24 located on the outer surface of the lip 21. These anchor point eyelets 24 are located at exactly opposing positions on the lip 21. The anchor point eyelets 24 are located at exact opposite locations on the surface of the lip 21. As viewed from the top, one anchor point eyelet 24 is located at the 12:00 o'clock position and one eyelet is at the 6:00 o'clock position, on the lip 21 of the bottom 20. Each anchor point eyelet 24 is oriented to facilitate securing the hook 22 of the bungee cord 18. The bottom 20 is secured to the trash receptacle cylinder 10 by use of two heavy elastic bungee cords 18. These two elastic bungee cords, a common item in most hardware stores, must have sufficient tension to hold the bottom 20 in place when the trash receptacle cylinder is loaded and still allow the bungee cord hook 22 to be disconnected from the trash receptacle cylinder handle 12. The assembled Yard and Trash Compactor configuration consist of the trash receptacle cylinder 10 inserted into a plastic trash bag 14 with the bottom 20 secured through the use of the two bungee cords 18, with one end of each bungee cord 18 hooked into the anchor point eyelet 24 on the anchor point 24 located on the bottom 20 and the other end secured to each handle 12. The bungee cord 16 holds the plastic bag 14 in place in a fully extended manner; being positioned and secured just below the edge of the mouth of the plastic bag 14. The bungee cord 16 is secured in this position by attaching the end bungee cord 16 hooks 18 to each other. The handle 12 is an integral part of the trash receptacle cylinder 10. While one end of the bungee cord 18 is secured to the bottom 20 anchor point eyelet 24 the other end of the bungee cord is attached to the handle 12 by securing the bungee cord hook 22 to the handle 12. In this manner the bottom 20 of the Yard and Trash Compactor is held secure to the trash receptacle cylinder 10, protecting the plastic trash bag 14 from puncture and from tearing during filling and movement. The trash receptacle cylinder 10 is a large hollow tube and is of sufficient diameter to fit inside a plastic trash bag 14 allowing minimum space between the inner surface of plastic bag 14 and the outer surface of the trash receptacle cylinder 10. FIG. 1 shows an elongated plastic trash bag 14 held in an elongated position on the trash receptacle cylinder 10 by a bungee cord 16 which is secured to itself by attaching each bungee cord hook 16 to itself. The length of the trash receptacle cylinder 10 allows the top of the cylinder to protrude from the elongated trash bag 14, leaving the handles 12 accessible for use. The volume of the trash bag 14 closely matches the volume of the trash receptacle cylinder 10. The trash receptacle cylinder 10 is made of rigid plastic or other light weight material which will withstand damage caused by puncture or cutting. The material used to construct the trash receptacle cylinder 10 must minimize surface friction between the trash bag 14 and the outer surface of the trash receptacle cylinder 10. The trash receptacle cylinder 10 inside diameter is consistent throughout the length of the cylinder. The inner surface of the cylinder is free from ridges, groves, or other deformities caused by rivets, screws, manufacturing stamping or bonding of materials which would increase friction between compressed trash and the inner surface of the trash receptacle cylinder 10. The outer surface of the trash receptacle cylinder 10 is equally smooth and also free from ridges, groves, or other deformities which would increase surface friction between the plastic bag 14 and the outer surface of the cylinder. The material used to construct the trash receptacle cylinder 10 must not lose its structural properties and characteristics when exposed to freezing temperatures, direct sun light, or normally occurring outdoor temperatures. The handles 12 are mounted near the upper end of the trash receptacle cylinder 10 and above the equator on the cylinder where the elongated plastic bag 14 would end. The handles 12 are of sufficient width to accommodate the human hand and are of sufficient strength to provide the appropriate strength needed of a load bearing lifting point for the movement of a fully loaded Yard and Trash Compactor. The handles 12 are secured to the trash receptacle cylinder 10 in the manufacturing process at equally opposing position to facilitate balancing the load equally between the two handles. The bungee cord 16 in position tension around the circumference of the trash receptacle cylinder 10, is critical to the operation of the invention and is generally no larger than 3/16 of an inch in diameter and of sufficient length and tension to hold the trash bag 14 in place in an elongated position. When the bungee cord 16 is stretched over the outer circumference of the trash receptacle cylinder 10, the bungee cord 16 creates surface pressure between the plastic bag 14 and the trash receptacle cylinder 10. The pressure created by the bungee cord 16 is a critical ingredient in the functioning of the invention. If the bungee cord 16 tension is not correct the device will not function during the transfer cycle. The bungee cord hooks 22 of bungee cord 16 provide the mean to secure the ends of the bungee cord 16 around the plastic bag 14 against the outer circumference of the trash receptacle cylinder 10. The compression piston 26 is used during the compression cycle of operation. Its outside diameter is smaller than the inner diameter of the trash receptacle cylinder 10 allowing the compression piston 26 to travel the length of the trash receptacle cylinder 10 during the compression cycle of operation. The compression piston is constructed of a strong and lightweight, rigid material, and is strong enough to accept 250 pounds of surface pressure without bending or breaking. The air release holes 28 allow air to escape from the cavity space between the bottom 20 and the compression piston 26 during the compression cycle of operation.

YARD AND TRASH COMPACTOR—OPERATION

Figure 2:
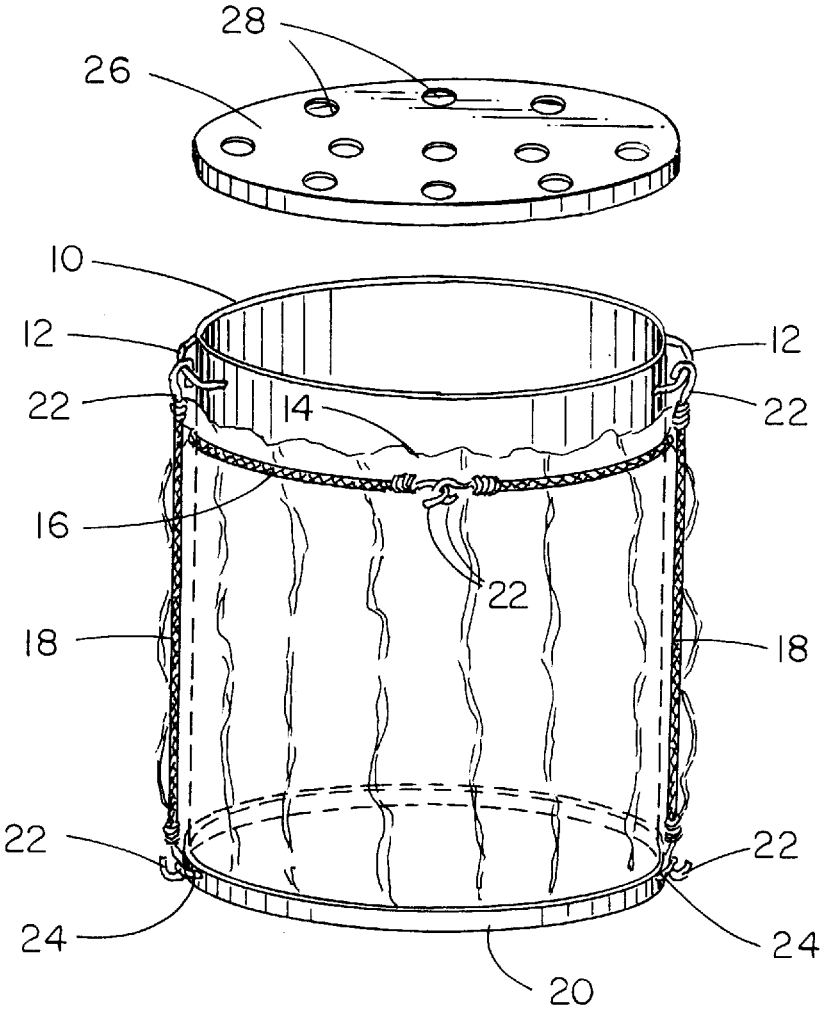
FIG. 2 is a perspective view of the assembled device inserted inside a plastic trash bag, ready for loading/filling, compression, and use.

The Yard Trash Compressor is a four part assembly consisting of a bottom 20 with bungee cords 18, a plastic trash bag 14, the trash receptacle cylinder 10 with bungee cord 16, and a compression piston 26. FIG. 1 shows a Yard and Trash Compactor in the first stage of assembly with trash receptacle cylinder 10 inserted inside an elongated plastic trash bag 14 and bungee cord 16 holding the plastic trash bag 14 secure at the upper end or mouth of the trash receptacle cylinder 10, with the handles 12 exposed and accessible for use. The trash receptacle cylinder 10 is inside the elongated plastic trash bag 14 providing protection to the plastic trash bag 14 during loading/filling and during the compression cycle. FIG. 2 depicts a completely assembled Yard and Trash Compactor ready for use and operation. The trash receptacle cylinder 10 is holding the mouth of the elongated plastic bag 14 open and the plastic bag 14 is secured in place by bungee cord 16 with each end of bungee cord attached to its hooks 22. The invention when placed in use has three cycles in its operation. In the first cycle the assembled device as shown in FIG. 2, is ready for the loading or filling cycle. Trash or yard debris is placed in the mouth of the trash receptacle cylinder 10. Once the cylinder is full the compression cycle begins and the compression piston 26 is placed on top of the loaded trash or debris and pressure is applied either by hand or foot to compress the debris within the trash receptacle cylinder 10. The compression piston 26 is removed at the end of the compression cycle and additional debris is loaded into the cylinder. The loading and compression cycles are repeated until the trash receptacle cylinder 10 is fully loaded with debris. The last cycle of operation is the transfer cycle where compressed trash and yard debris is transferred from the secure confinement of the trash receptacle cylinder 10 to the elongated plastic trash bag 14. During this cycle of operation the two large bungee cords 18 holding the bottom 20 in place are released from the trash receptacle cylinder handles 12 freeing the bottom 20 from the cylinder. The bungee cord 16 tension is a critical specification; the tension of bungee cord 16 prevents the top of the elongated plastic bag 14 from falling down the side of the trash receptacle cylinder 10 during the transfer cycle of operation. With the bottom 20 disconnected from the bottom of the trash receptacle cylinder 10, the trash receptacle cylinder 10 is pulled from the inside of the plastic bag 14 by using the handles 12. The bungee cord 16 tension creates enough pressure between the plastic bag 14 and the trash receptacle cylinder 10 to keep the bungee cord 16 in position during the transfer cycle. The debris is transferred to the elongated plastic bag 14 as bungee cord 16 travels down the side of the trash receptacle cylinder 10. As the bottom of the trash receptacle cylinder 10 is pulled from the mouth of the plastic bag 14 the bungee cord 16 slides off the cylinder and secures the mount of the plastic trash bag 14 closed. Bungee cord 16 tension is a critical specification. If the tension is too high the plastic trash bag 14 is damaged when the weight of the debris inside the trash receptacle cylinder 10 pulls the plastic bag down the length of the cylinder during the transfer cycle or the plastic trash bag is pulled or torn from under the bungee cord 16 and the debris is lost outside of the edges of the collapsed plastic bag as the bottom of the trash receptacle cylinder 10 is removed from the plastic bag 14. If the tension is too low the plastic bag is pulled from under bungee cord 16 and debris is lost in a similar manner as mentioned above. Once the trash receptacle cylinder 10 is completely out of the plastic trash bag 14 the bungee cord 16 closes around the top of the plastic trash bag holding it temporarily closed so no debris is lost at the end of the transfer cycle. The bungee cord 16 is removed from the plastic bag, the plastic bag is tied off in the conventional manner and the Yard and Trash Compactor is reloaded with a plastic trash bag 14 as depicted in FIG. 2.

CONCLUSION, RAMIFICATIONS AND SCOPE OF INVENTION

Thus the reader can see that the Yard and Trash Compactor permits the user to fill plastic trash bags with compressed yard debris making maximum use the plastic trash bag's total volume. The invention allows the user to load, compress, and move fully loaded plastic trash bags from one location to another without damage to the plastic bag or loss or its contents. Filling plastic trash bags becomes a one man operation. Loading plastic trash bags with yard debris such as leaves and grass clippings using the Yard and Trash Compactor is less time consuming and easier to accomplish. Fewer plastic trash bags are needed to eliminate yard debris from the premises. If this device were used extensively, fewer plastic trash bags would end up in land fills and municipal dump sites. Those skilled in the art can see many other possible variations are within its scope. Changing the length, diameter, or shape of the trash receptacle cylinder 10 and thereby changing the dimensions of the device is possible. Different manufacturing possibilities exist in terms of shape which represent nothing more than altering the embodiments presented here. This invention is designed to compress yard debris sufficiently enough to make maximum use of all available volume offered by the plastic bag used without damage to the bag during loading and compression. Accordingly the reader is requested to determine the scope of the invention by the appended claims and their legal equivalents, and not by the examples which have been given.

We Claim:

1. A yard debris collection receptacle used to hold open a plastic trash bag for vertical loading or filling comprising:

(a) a hollow, rigid open ended cylinder having a smooth inner and outer surface and consistent inside diameter throughout the length of said cylinder and of an appropriate size to fit inside said plastic trash bag leaving little room between said cylinder and said plastic trash bag, said trash bag being held in an elongated position along said cylinder by a bungee cord of specific dimension, length, and tension, wrapped and secured end to end around the top of said plastic bag held against said cylinder, said cylinder having a pair of handles located on the outside of said cylinder and at one end of said cylinder allowing sufficient room between the end of said elongated trash bag and said handles for carrying said cylinder, (b) a durable, attachable and detachable bottom which caps off the bottom end of said cylinder through use of two heavy duty bungee cords of specific length and strength attached to said bottom and secured to said cylinder handles.

2. The bungee cord of claim 1 wherein said bungee cord tension permits said bungee cord to move along the length of said trash receptacle cylinder as said cylinder is removed from said plastic trash bag finally securing the mouth of said plastic trash bag closed as said cylinder is removed from said trash bag.

3. A device which permits yard debris such as grass clippings, leaves, hedge trimmings, weeds and trash to be compressed and transferred inside a plastic trash bag comprising:

(a) a hollow, rigid open ended cylinder having a smooth inner and outer surface and consistent inside diameter throughout the length of said cylinder and of an appropriate size to fit inside said plastic trash bag leaving little room between said cylinder and said plastic trash bag, said trash bag being held in an elongated position along said cylinder by a bungee cord of specific dimension, length, and tension, wrapped and secured end to end around the top of said plastic bag held against said cylinder, said cylinder having a pair of handles located on the outside of said cylinder and at one end of said cylinder allowing sufficient room between the end of said elongated trash bag and said handles for carrying said cylinder, (b) a durable, attachable and detachable circular bottom of sufficient thickness to cap off the bottom end of said cylinder through use of two heavy duty bungee cords of specific length and strength attached to said bottom and secured to said cylinder handles, said bottom protects said plastic bag by reinforcing the bottom of said plastic bag, allowing yard debris to be compressed inside said cylinder and against said bottom through use of, (c) a sturdy, rigid flat piston plate with air release holes capable of fitting inside the said cylinder, whereas yard debris is compressed by using body weight pressure against said piston plate in a downward manner while said piston plate is on top of debris inside said cylinder, compressing debris and making more room for additional debris to be loaded into said cylinder, whereby the user will use fewer plastic bags in the process of bagging yard debris for collection.

4. An assembly which allows plastic trash bags to be filled without damage to said plastic bag and making maximum use of all available volume of said plastic bag and permitting the movement of said heavily loaded plastic trash bags to a location for pickup by local trash collectors comprising:

(a) a hollow, rigid open ended cylinder having a smooth inner and outer surface and consistent inside diameter throughout the length of said cylinder and of an appropriate size to fit inside said plastic trash bag leaving little room between said cylinder and said plastic trash bag, said trash bag being held in an elongated position along said cylinder by a bungee cord of specific dimension, length, and tension, wrapped and secured end to end around the top of said plastic bag held against said cylinder, said cylinder having a pair of handles located on the outside of said cylinder and at one end of said cylinder allowing sufficient room between the end of said elongated trash bag and said handles for carrying said cylinder, (b) a durable, attachable and detachable bottom which caps off the bottom end of said cylinder through use of two heavy duty bungee cords of specific length and strength attached to said bottom and secured to said cylinder handles.

5. The cylinder of claim 4 wherein said cylinder has both inner and outer surfaces which are smooth and said cylinder is constructed of material which is rigid and weather resistant.

* * * * *